United States Patent [19]

Green et al.

[11] Patent Number: 4,640,675

[45] Date of Patent: Feb. 3, 1987

[54] METHOD OF BURNING LOW HYDROGEN CONTENT FUELS

[75] Inventors: Gary J. Green, Yardley, Pa.; Harry A. McVeigh, Morrestown; Joe E. Penick, Princeton, both of N.J.; Tsoung Y. Yan, Philadelphia, Pa.

[73] Assignee: Mobil Oil Corporation, New York, N.Y.

[21] Appl. No.: 659,124

[22] Filed: Oct. 9, 1984

[51] Int. Cl.[4] ..... F23C 1/00

[52] U.S. Cl. ..... 431/2; 44/52; 48/197 FM; 431/4

[58] Field of Search ..... 431/2, 3, 4; 44/50, 44/52; 48/197 FM; 208/48 R

[56] References Cited

U.S. PATENT DOCUMENTS

| | | | |
|---|---|---|---|
| 2,866,693 | 12/1958 | Allen | 44/52 |
| 3,672,853 | 6/1972 | Roman et al. | 44/52 |
| 4,017,268 | 4/1977 | Gilley | 44/52 |
| 4,045,189 | 8/1977 | Bruni et al. | 44/52 X |
| 4,197,081 | 4/1980 | Osborg | 431/2 |
| 4,490,152 | 12/1984 | Bruni et al. | 44/50 |

FOREIGN PATENT DOCUMENTS

| | | | |
|---|---|---|---|
| 134365 | 2/1979 | Fed. Rep. of Germany | 431/4 |
| 78491 | 5/1982 | Japan . | |
| 840351 | 7/1960 | United Kingdom | 431/4 |

*Primary Examiner*—Margaret A. Focarino
*Attorney, Agent, or Firm*—A. J. McKillop; M. G. Gilman; M. V. Schneller

[57] ABSTRACT

Decreasing the viscosity of and improving the atomizing and burning characteristics of a hydrogen deficient fuel by dissolving a light, hydrogen rich hydrocarbon in the fuel.

15 Claims, 3 Drawing Figures

METHOD OF BURNING LOW HYDROGEN CONTENT FUELS

BACKGROUND OF THE INVENTION

1. Field of the Invention

The invention relates to a process for the preparation of a liquid fuel suitable for burning using a pressure-type atomizer, using a hydrocarbon feed relatively low in hydrogen content and the combustion of such fuel.

2. Relevant Art

It is difficult to burn low quality fuels, e.g., resids, efficiently with minimum impact on the environment, i.e., complete combustion with low soot formation and low particulate emissions.

Low quality, heavy fuels such as resids are used to fuel power plants, ship boilers, and some refinery process units. These fuels are deficient in hydrogen and prone to form soot, leading to black smoke and particulate emissions. It is known that such fuels can be upgraded by hydrogenation. Hydrogenation of heavy resids is a very expensive refinery process, because of the high pressure required and high hydrogen consumption. As an alternative to the chemical addition of hydrogen to residual fuels to improve their combustion quality, the art has sought alternative ways of improving these fuels.

A significant improvement in the efficiency of burning heavy fuels can be achieved if a pressure-type atomizer is used. These atomizers result in the formation of minute droplets of liquid which leave the atomizer to enter a combustion chamber. Usually the feed is heated before reaching the atomizer, so that the viscosity of the feed is low enough for the feed to be atomized. Typically, atomizers work with feeds with a viscosity, measured at the temperature encountered in the atomizer, below 100 CS, and preferably below about 20 CS.

The art has recognized that pressure atomization is not a complete solution, and has attempted to overcome the shortcomings of this method by adding various substances to the feed which promote vaporization and/or reduce the viscosity of the feed. Typical of this work is that described in U.S. Pat. No. 3,672,853, the entire contents of which is incorporated herein by reference. The patentees taught dissolving carbon dioxide, hydrogen or water vapor in the feed in an amount not exceeding 95 percent of the maximum amount that can dissolve at the temperature and pressure just before atomization. The dissolved materials all reduced the viscosity of the feed. At 280° C., 95 kg/cm$^2$ $CO_2$ pressure, the viscosity of a heavy feed was reduced from 1670 CP to 820 CP, with the dissolution of $CO_2$.

In a similar test, with hydrogen addition, more than twice this pressure was used. A feed with an initial viscosity at 280° C. of 1580 CP was reduced to 1350 CP.

Another example in this reference showed equilibrating the same feed used in Example 1 with steam at a steam pressure of 60 kg/cm$^2$ which resulted in reducing the viscosity by approximately a factor of 2 (based on linear extrapolation).

At the 280° C. temperature, hydrogen was by far the least effective additive regards viscosity reduction, and also the least effective regards the severity of conditions needed to dissolve the gas, hydrogen in this case, in the heavy liquid feed. The effectiveness of the hydrogen as a viscosity reducer tended to increase, relative to $CO_2$ and $H_2O$, at higher temperatures.

The patentee did not report any results of actual burning experiments using any of these additives, namely $CO_2$, $H_2$, or $H_2O$. Apparently the inventors sought better atomization of fuel, rather than reduced sooting tendency. One advantage mentioned for the process was permitting burning heavy fuels to form soot, and recycle the soot back to the feed. Soot recycle increases feed viscosity, but the viscosity would then be lowered by the practice of their invention.

Unfortunately, none of the solutions to minimizing the sooting tendency of heavy, halogen deficient fuels suggested by U.S. Pat. No. 3,672,853 was completely satisfactory.

Use of atomizing steam improves combustion of heavy fuels, but sooting was still a problem.

$CO_2$ is a moderately expensive, and corrosive, commodity. Addition of $CO_2$ reduces the viscosity of a heavy feed, but does nothing towards reducing the sooting tendency of a heavy feed, although better atomization may reduce soot formation.

Dissolution of hydrogen in a heavy feed reduces the sooting tendency of the feed, but hydrogen gas is a very valuable commodity in a refinery. It would be expensive, in terms of compression costs if nothing else, to achieve sufficiently high hydrogen partial pressures to significantly reduce the viscosity and (inherently) the sooting tendencies of a heavy fuel. Many existing fuel distribution systems, atomizers, pumps, etc. could not tolerate the high pressures required.

Some work was done in Japanese Pat. No. 78491 towards reducing the smoking tendency of diesel fuels. Basically an LPG, or liquified petroleum gas stream consisting primarily of propane and butane is dissolved in a tank of diesel fuel to reduce the sooting tendency.

Diesel fuel is a good quality fuel if you just want to burn it in a boiler or process heater. No elaborate steam atomization, etc. is required to cleanly burn this premium liquid fuel. Improving the burning characteristics of diesel fuel by adding valuable materials such as propane and butanes represents very poor use of these materials, but such a fuel would have little sooting tendency.

Other hydrogen deficient fuels range from very light materials, such as acetylene, to heavier liquids, such as highly aromatic fuels such as toluene or liquids derived from coal.

We discovered a way to improve the burning tendencies of these hydrogen deficient light and heavy fuels, without resorting to the use of hydrogen, and the high cost both of the raw material and the compression costs associated with dissolving the hydrogen in the fuel. We discovered an efficient and economical way to upgrade hydrogen deficient fuels, at least as far as reducing their sooting tendencies, by addition of light hydrocarbon gases to the fuel. Some viscosity reduction, and improved atomization of heavy fuels will also be achieved.

BRIEF SUMMARY OF THE INVENTION

Accordingly, the present invention provides a process for improving the quality of a relatively low hydrogen content hydrocarbon fuel comprising dissolving in said fuel a hydrogen rich gas selected from the group of natural gas, methane, ethane, ethylene, and mixtures thereof in an amount sufficient to reduce the sooting tendency to said fuel and wherein a majority of said gas dissolves in said fuel at the temperature and pressure prevailing in the proximity of a burner atomizer used to atomize said fuel.

In a more limited embodiment, the present invention provides a process for reducing the sooting tendency of a heavy residual fuel comprising dissolving in said fuel from 0.5 to 20 wt% of a gas selected from the group of natural gas, methane, ethane, ethylene, and mixtures thereof.

In another embodiment the present invention provides an improved process for burning a heavy residual fuel with about 10–13 wt% hydrogen which is injected into a burning zone via an atomizer and wherein said fuel has a viscosity at the atomizer of at least about 20 centistokes, the improvement comprising dissolving in said residual fuel 1 to 20 wt% of a light hydrogen rich hydrogen whereby the viscosity is reduced and the hydrogen content of said residual fuel is increased.

DETAILED DESCRIPTION OF THE INVENTION

Hydrogen Deficient Fuels

Figure 1:
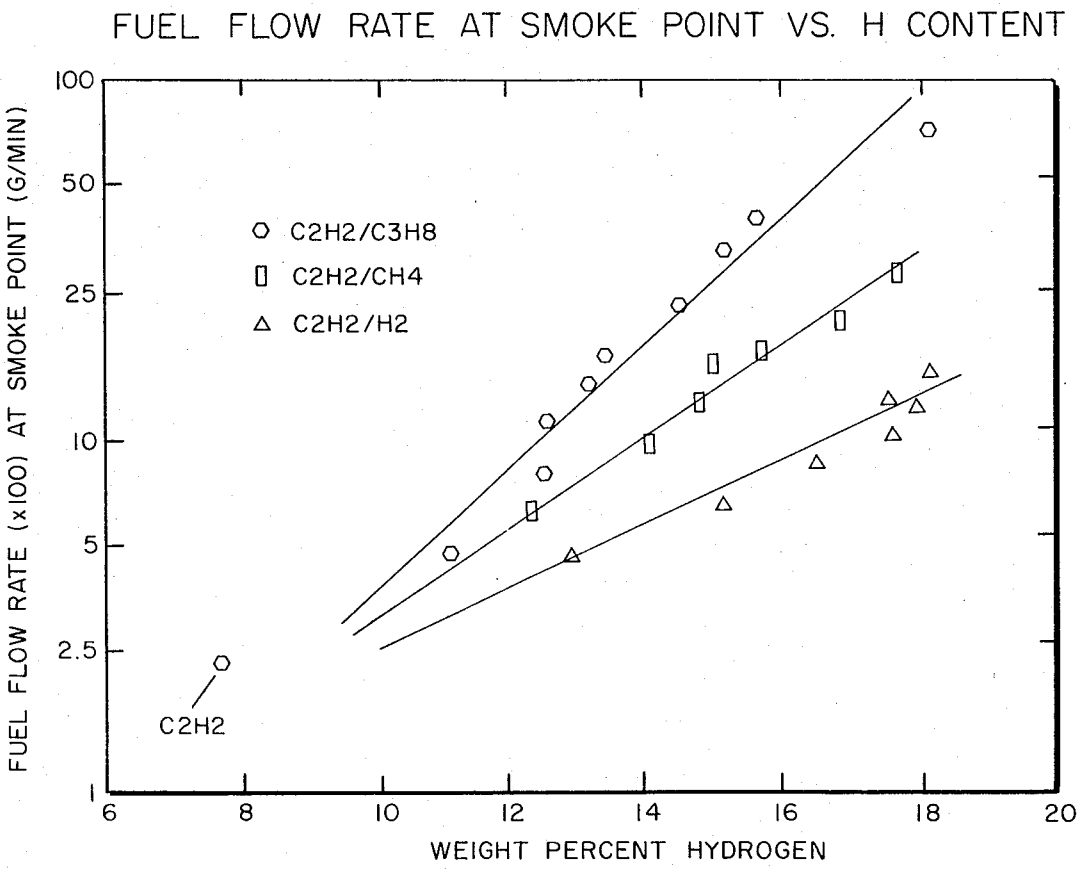
FIG. 1 is a graph of the plot of fuel flow rate (X100) at smoke point (G/Min) versus weight percent hydrogen.

The present invention may be used to upgrade the burning characteristics of any hydrogen deficient fuel.

Such fuels may be derived from all or portions of crude oil, tar sands, and may also contain combustible additives such as soot particles, coke particles, coal particles, and combinations thereof. They may be normally gaseous, acetylene is an example, but are usually liquids. Relatively light liquids may be hydrogen deficient, such as toluene and benzene. Middle distillate boiling range fuels, such as liquids derived from coal, may be hydrogen deficient. Heavy fuels, such as resids, are very aromatic and are usually hydrogen deficient.

The fuels which will benefit most from the practice of the present invention will generally have at least one, and frequently both, of the following characteristics:

1. High viscosity
2. High sooting tendency

The process of the present invention permits burning of some feeds which are highly viscous, such as asphaltic fractions, which are not suitable for use as fuel. These fuels have viscosity so high that most burners, even with pressure and steam assisted atomization, do not handle these fuels well. As burner technology improves, slightly more viscous fuels can be handled, so the concept of high viscosity is a moving target. In general, feeds are considered viscous, if they have viscosities, on a light hydrogen rich hydrocarbon free basis, above about 20 centistokes, and very viscous if they have viscosities above 100 centistokes, at the temperatures typically experienced in an atomizer in a burner.

These low quality, viscous heavy residual fuels are deficient in hydrogen and prone to form soot. Relatively light hydrogen deficient fuels may have a sooting tendency, e.g., acetylene is a premium quality fuel, but forms soot easily upon burning.

When heavy fuels such as a resid are used herein, these may be subjected to one or more refinery processes to reduce the viscosity thereof. Visbreaking or mild thermal cracking to reduce the viscosity of the heavy feed is very commonly practiced in refineries. Such processing reduces the viscosity of the fuel, but generates some light ends leaving a slightly more hydrogen-deficient liquid product, albeit with a reduced viscosity.

When residual fuel is used as a feedstock, it will frequently be blended with one or more less viscous refinery streams, such as cutter stock, to reduce the viscosity of the fuel oil. Such blending to reduce viscosity may be used in conjunction with, or instead of, visbreaking. Blending usually will reduce viscosity, but may not have much effect on sooting tendency. This is so especially when highly aromatic cutter stocks are used. These aromatic rich materials such as FCC slurry oils, are also relatively hydrogen deficient.

All, or most likely a portion, of heavy hydrogen deficient fuels may be subjected to conventional chemical hydrotreating processes in a refinery to reduce the sulfur and nitrogen content. Such chemical hydrogenation is very expensive upgrading treatment for a heavy residual fuel which will be burned, but it will reduce somewhat the sooting tendency of the residual fuel.

Light Hydrogen Rich Hydrocarbon

This term is intended to cover hydrocarbons that are normally liquid or normally a gas. The term light hydrocarbon gas means only normally gaseous stream that contains at least a molar majority of the so-called dry gases, methane, ethane and ethylene. Natural gas is suitable.

These gas streams are commonly found in refineries and petrochemical plants. They have value in a refinery, primarily because of their heating value, and that is typically the only value of these gases. They are usually complex mixtures containing some hydrogen, and some propane, and perhaps butane and heavier gases.

As used herein, the term light hydrocarbon gas would not include a stream which is more than 50 mole % hydrogen. Not only are such hydrogen rich streams difficult to dissolve in heavy fuel oils, such hydrogen streams also have significant chemical value for use in hydrotreating, hydrocrackers, or elsewhere within a refinery or petrochemical unit.

Light hydrogen rich hydrocarbons which are not usually considered as gases are propane, propylene, butanes and heavier. These materials are valuable as fuels, or petrochemical feedstocks. There is usually no economic justification for adding a relatively high volume, low density product like propane to a heavy fuel, that simply converts a high value product into a relatively low value product. Such materials, e.g., $C_3$, $C_4$, light naphthas, may be added when sooting problems are mild or intermittant and where cheaper gases are not available or where the atomizer and related piping cannot tolerate high pressures required to dissolve gas in the residual fuel.

The presence of some significant amounts of LPG fractions, e.g. propanes and butanes, is not harmful to the practice of the present invention, except in an economic sense, in that these materials are worth more than heavy fuel. These LPG components do upgrade the burning characteristics of fuels, reduce the viscosity of the heavy fuels, and require relatively low pressures to maintain liquid phase operation. In some fuels, especially heavy fuels, which have been subjected to severe visbreaking or thermal cracking, the addition of propane and butane may cause some instability in the fuel.

To avoid running a propane-deasphalting process in the feed lines to burner atomizers, the amount of propanes and butanes added should be minimized when a feed containing larger amounts of asphaltenics is used. Deasphalting is usually not a problem when cleaner, relatively light, but highly aromatic fuels are used, such as those derived from solvent refined coal.

One way to achieve many of the benefits of adding a light hydrocarbon without causing instability of the fuel is to add the light hydrocarbon either at the atomizer, or just prior to the fuel atomizer. The viscosity reduction of the fuel will be almost instantaneous, and will occur as soon as the light hydrocarbon dissolves in the liquid. The fuel instability, or precipitation of asphaltics, will start almost instantaneously, but will not have sufficient time to proceed to a point where a significant sedimentation problem will exist.

Usually the amount of light hydrocarbon added to the hydrogen deficient fuel will be relatively small, on the order of 0.5–20 wt.% of the fuel, and preferably 1–10 wt.% of the fuel.

Preferably the amount, and location of light hydrocarbon addition are selected so that fuel sedimentation is not a problem. The location of the point of addition of the light hydrocarbon gas has a profound effect upon sediment formation. As discussed above, even fuels with a tendency to form sediment can benefit from the practice of the present invention so long as the light hydrocarbon is added at or near the atomizer. When the light hydrocarbon is added at some upstream point in the fuel distribution chain, care should be taken to limit the amount of light hydrocarbon addition to that level which will not cause significant sedimentation between the point of gas addition and the burner.

If sedimentation is a problem, it may be possible to adjust for this, by simply increasing the temperature of the heavy, hydrogen deficient fuel to minimize sediment forming.

Preferably enough light, hydrogen-rich hydrocarbon is dissolved in the fuel to result in a reduction of sooting tendency, and, in the case of heavy fuels, a significant viscosity reduction.

The upper limit on the amount of light, hydrogen-rich hydrocarbon that is dissolved in the fuel is set by a number of factors—primarily gas pressures and economics.

The fuel delivery equipment used in a refinery or power plant installation may be rated for a certain pressure, and it may not be possible to dissolve the light hydrocarbon at the pressure limit set by pressure considerations of burner piping, or of equipment used to dissolve the light, hydrogen rich hydrocarbon in the heavy fuel.

Economics involves comparing the relative cost of different fuels available for burning in the refinery or power plant, efficiency of atomizers, amount and quality of atomizing steam, if any, amount of excess air, and heat input required.

In general, adding more combustion air to the furnace reduces soot and smoke formation, but at a price, reduced burner efficiency and loss of heat up the furnace stack.

In general, as heat input in a burner increases, the tendency to form soot and smoke increases. The sooting tendency may be adjusted by addition of more combustion air, or by increasing the amount of light hydrocarbon dissolved in the fuel.

Another practical limit on the amount of light hydrocarbon that can be added to the unit is that the amount added should be small enough so that essentially all of the light hydrocarbon added will remain dissolved in the heavy feed at the temperature and pressure prevailing in the line immediately before the atomizer.

Light Hydrocarbon—Fuel Mixer

Any conventional means of adding a relatively light hydrocarbon, preferably a light hydrocarbon gas, e.g., consisting primarily of methane and ethane, to a heavy liquid stream can be used.

In its simplest form, the dissolving means can be simply a length of pipe. More elaborate mixing means can be provided, such as the static mixers which divide and recombine a flowing fluid stream many times as it passes through a length of pipe. Alternatively, or in conjunction with such static mixers, a low efficiency centrifugal pump, or simply a pinched valve or venturi section of pipe may be used to promote better mixing of dry gas and heavy oil. Depending on local economics, it may be beneficial to add the light hydrocarbon to the fuel at a location remote from the furnace, to take advantage of slightly reduced pumping effort required to move the less viscous fuel oil. Alternatively, it may be preferred to add the light hydrocarbon just upstream of the burner, to minimize the amount of high pressure equipment, and concerns about vapor formation in long lengths of pipe.

Atomizers

Any conventional atomizer can be used in conjunction with the present invention. The invention is not a better burner, it is a way to make existing heavy fuels burn better in conventional atomizers.

Conventional mechanical atomizers may be used. Typically, a mechanical-atomizing burner receives the oil under a pressure of about 15–20 atmospheres, absolute, preferably at a viscosity of about 150 SSU. Typically, an orifice atomizes the fuel.

Other burner designs are known, such as steam-atomizing burners wherein a high pressure air or steam supply, or combination, is mixed with the heavy fuel either just before, concurrently with, or immediately after discharge into a furnace for combustion.

Experimental

The experimental program was divided into two parts. The first part was simply a computerized material balance showing the pressure required to dissolve a given amount of gas into a typical residual fuel, the 850° F.+ Arabian light residual shown in Table 1.

TABLE 1

| Residual Fuel Oil Properties<br>Resid from Arabian Light Crude | |
|---|---|
| IBP °F. | 850+ |
| IBP °C. | 454+ |
| Gravity, °API | 11.7 |
| Specific Gravity, 60/60° F. | 0.9883 |
| Pour Point, °F. | 55 |
| Pour Point, °C. | 13 |
| Viscosity @ 100° C., Cs. | 109.13 |
| Pulfur, % wt. | 3.56 |
| Carbon Residue, CCR, % wt | 11.6 |
| Nickel and vanadium, ppm | 61 |
| GAS MIXTURES ADDED | |
| 1. 100% methane | |
| 2. 100% ethane | |

TABLE 2

| Estimated Pressure to dissolve | | | |
|---|---|---|---|
| Temperature | 1 wt. % $CH_4$ KPa/PSIA | 10 wt. % $CH_4$ KPa/PSIA | 20 wt. % $CH_4$ KPa/PSIA |
| 20° C. | 3100/450 | 13,800/2000 | 27,600/4000 |
| 40° C. | 3450/500 | 17,200/2500 | 34,500/5000 |
| 100° C. | 4140/600 | 20,700/3000 | — |
| 200° C. | 4830/700 | 27,600/4000 | — |
| Temperature | 1 wt % $C_2H_6$ KPa/PSIA | 10 wt. % $C_2H_6$ KPa/PSIA | 20 wt. % $C_2H_6$ KPa/PSIA |
| 20° C. | 345/50 | 2070/300 | 3450/500 |
| 40° C. | 448/65 | 2760/400 | 4830/700 |
| 100° C. | 1034/150 | 5860/850 | 10340/1500 |
| 200° C. | 2068/300 | 13800/2000 | 24820/3600 |

EXAMPLE 2

This example represents actual experiments to illustrate the principle. It should be noted that all of the experiments are outside the scope of the claims, in that the light hydrocarbon gases were not dissolved in a liquid, but rather physically mixed with the hydrogen deficient fuel, in this case, acetylene. The experiment is a valid measure of the ability of methane and propane to reduce the sooting tendency of a hydrogen deficient fuel.

The experimental apparatus consisted basically of a laminar diffusion flame burner supplied with a mixture of acetylene and light, hydrogen rich gas. Once a flame is established, the flow rate of the acetylene is increased relative to the flow rate of light hydrogen rich gas until incipient sooting (smoke point) is observed.

The oxidant used was a 40/60 mixture of $O_2/N_2$, on a molar basis. The gases added were $H_2$, $CH_4$ and $C_3H_8$.

Figure 2:
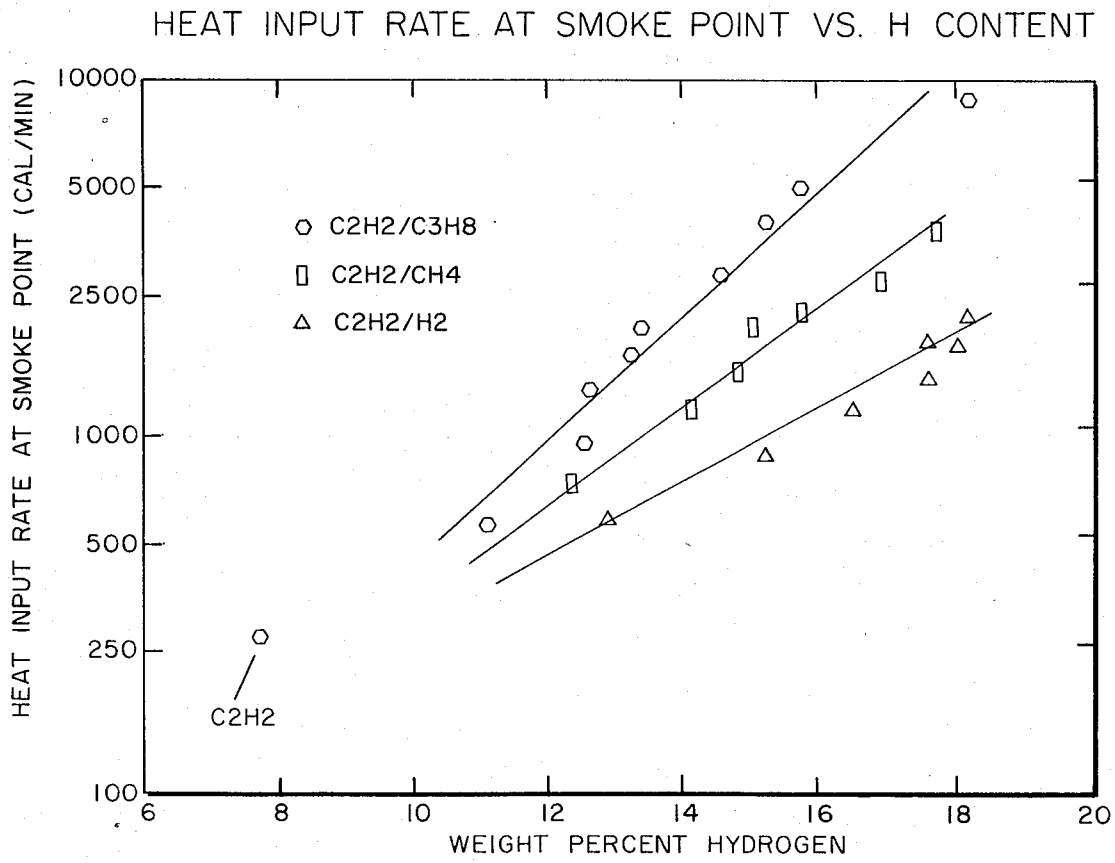
FIG. 2 is a graph of the plot of heat input rate at the smoke point (Cal/Min) versus weight percent hydrogen.

The total fuel flow rate and fuel composition are recorded. This procedure is carried out over a range of fuel flow rates and compositions. We discovered that the total fuel hydrogen content of the mixture is a good indicator of sooting tendency. The results of these smoke point observations are plotted as a function of total fuel hydrogen content and shown in FIG. 1. It is also possible to present these experimental results on the basis of heat input rate, rather than fuel flow rate. These results are shown in FIG. 2.

These experiments show that addition of a light hydrogen-rich hydrocarbon (methane or propane) to a hydrogen deficient fuel (acetylene) can significantly reduce the sooting tendency of the hydrogen deficient fuel, and allow greatly increased throughput.

EXAMPLE 3

This example represents experiments conducted with a normally liquid, hydrogen deficient fuel. Toluene was the fuel used, instead of the acetylene used in Example 2.

Because toluene is a liquid, some modifications were necessary to the experimental apparatus. In this example, a liquid pool diffusion frame burner was used. A pool of liquid toluene was allowed to accumulate in an inverted funnel. Light, hydrogen rich gas was added just above the surface of the pool of liquid toluene, at the base of the flame. Addition of liquid toluene was precisely controlled using an ISCO pump.

The oxidant gas used was the same, namely a 40/60 percent mixture of oxygen and nitrogen, on a molar basis. The light, hydrogen-rich gases used as blending components were $H_2$, $CH_4$ and $C_3H_8$. In this experiment, as in example 2, the light hydrogen-rich gases were not dissolved in a liquid fuel, rather they were physically mixed with vaporized toluene just prior to burning of the toluene.

Figure 3:
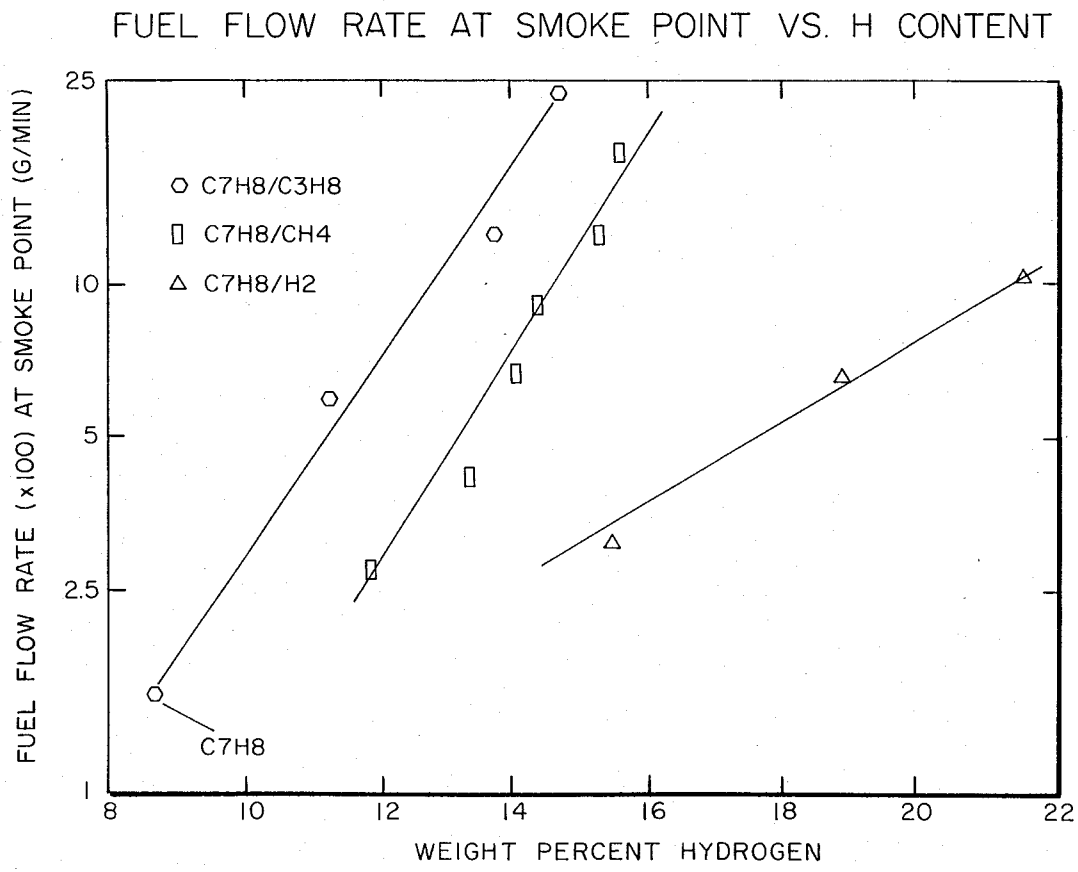
FIG. 3 is a graph of the plot of fuel flow rate (X100) at smoke point (G/Min) versus weight percent hydrogen.

Experimental results of this test are shown in FIG. 3, comparing the fuel flow rate at smoke point versus hydrogen content of the gas mixture that is being burned. This plot is analogous to FIG. 1, in that both FIG. 1 and FIG. 3 deal with fuel flow rate at the smoke point versus hydrogen content, while FIG. 2 deals with heat input rate versus hydrogen content.

In FIG. 3, the toluene/$H_2$ mixtures had smoke point values that climbed much more slowly relative to those for the $C_3H_8$ and $CH_4$ mixtures. This may mean that the very light hydrogen gas did not have time to adequately mix with toluene vapor prior to combustion, in contrast to the heavier gases $CH_4$ and $C_3H_8$ which presumably mixed better with the vaporized toluene.

EXAMPLE 4

Mixing Effect

To show conclusively that intimate mixing of the hydrogen-rich light hydrocarbon gas with the hydrogen-deficient fuel is necessary to achieve a reduction in sooting tendency, additional experiments were carried out where the hydrogen-rich gas was introduced to the burner along with the combustion air, and not directly into the fuel side of the flame. In this example, propane was added to the combustion air surrounding the toluene flame at levels equivalent to 12 to 17 wt% total fuel hydrogen. No effect whatsoever was observed on soot reduction of the flame.

The present invention, which requires that the light, hydrogen-rich hydrocarbons be dissolved in the hydrogen deficient fuel prior to combustion, will automatically satisfy this intimate mixing requirement.

Best Mode

If we were practicing the present invention today, using a feedstock such as the heavy oil feed described in Example 1, we would add about 10 wt.%, based on heavy fuel oil, of a mixture of natural gas, primarily methane and ethane to the fuel oil. The gas would be dissolved in the oil by adding the gas to a short length of pipe just before the burner, carrying heavy fuel oil at a temperature of 40° C. and pressure of about 1000 psig (7000 kPa). A conventional steam-atomizing burner would be used.

We claim:

1. A process for improving the quality of a relatively low hydrogen content hydrocarbon fuel comprising dissolving in said fuel a hydrogen rich gas, comprising methane wherein said hydrogen rich gas is present in an amount sufficient to reduce the sooting tendency of said fuel and wherein a majority of said gas dissolves in said fuel at the temperature and pressure prevailing in the proximity of a burner atomizer used to atomize said fuel.

2. Process of claim 1 wherein from 0.5 to 20 wt% of gas, on a gas-free fuel basis, is dissolved in said low hydrogen content fuel.

3. Process of claim 1 wherein from 1 to 10 wt% of gas, on a gas-free fuel basis, is dissolved in said low hydrogen content fuel.

4. Process of claim 1 wherein said fuel is selected from the group consisting of of residual fuel, coal liquids and oil derived from tar sands.

5. Process of claim 1 wherein said fuel has a hydrogen content not exceeding 13 wt%.

6. Process of claim 1 wherein said fuel has a hydrogen content of 10 to 13 wt%.

7. Process of claim 1 wherein said gas comprises a mixture of methane and ethane.

8. Process of claim 1 wherein said gas is a refinery offgas.

9. Process of claim 1, wherein said methane is admixed with a gas selected from the group consisting of ethane, ethylene, and mixtures thereof.

10. Process of claim 1, wherein the source of methane is natural gas.

11. In a process for burning a heavy residual fuel by injecting said fuel into a burning zone via an atomizer and wherein said fuel has a viscosity at the atomizer of at least about 20 centistokes, the improvement comprising dissolving in said residual fuel 1 to 20 wt% of a light hydrogen rich hydrocarbon, which comprises methane and at least one other gas selected from the group consisting of ethane, propane, butane, ethylene, propylene and butylene, admixed with the methane, whereby the viscosity and sooting tendency of said fuel are reduced.

12. Process of claim 11 wherein said fuel has a viscosity measured on a light hydrocarbon free basis, at the atomizer of at least about 100 centistokes.

13. Process of claim 11 wherein said heavy residual fuel has a hydrogen content of about 10–13 wt%.

14. Process of claim 11, wherein the source of said methane is refinery off gas.

15. Process of claim 11 wherein the source of said light hydrocarbon is natural gas.

* * * * *